US006006865A

United States Patent [19]

Ammon

[11] Patent Number: 6,006,865

[45] Date of Patent: Dec. 28, 1999

[54] LIFT INSTALLATION WITH DRIVE UNIT ARRANGED IN THE LIFT SHAFT

[75] Inventor: Urs Ammon, Ebikon, Switzerland

[73] Assignee: Inventio AG, Hergiswil, Switzerland

[21] Appl. No.: 08/960,963

[22] Filed: Oct. 30, 1997

[30] Foreign Application Priority Data

Nov. 11, 1996 [EP] European Pat. Off. ..... 96810762

[51] Int. Cl.[6] ..... B66B 11/08

[52] U.S. Cl. ..... 187/266; 187/404

[58] Field of Search ..... 188/266, 254, 188/261, 404, 41, 4; 182/141

[56] References Cited

U.S. PATENT DOCUMENTS 3,101,130 8/1963 Bianca ..... 187/266

FOREIGN PATENT DOCUMENTS 0202525 11/1986 European Pat. Off. .
0710618 5/1996 European Pat. Off. .
8807219 9/1988 Germany .

*Primary Examiner*—Kenneth W. Noland
*Attorney, Agent, or Firm*—Schweitzer Cornman Gross & Bondell LLP

[57] ABSTRACT

A lift installation or assembly in which a lift cage and counterweight are driven by cables of a drive unit, which is arranged in a lift shaft. A carrier yoke is arranged at the upper ends of first and second guide elements. For mounting, maintenance and repair operations the drive unit can be pivoted into the lift shaft by means of a rotary mechanism arranged at the carrier yoke.

11 Claims, 4 Drawing Sheets

LIFT INSTALLATION WITH DRIVE UNIT ARRANGED IN THE LIFT SHAFT

The present invention relates to a lift installation with a drive unit which is arranged at the upper end of a lift shaft, having a drive pulley for driving cables supporting a counterweighted lift cage, which is guided in the lift shaft at guide elements.

BACKGROUND OF THE INVENTION

From Utility Model DE-GM 88 07 219 there has become known an elevator lift installation with a frame which reaches from the floor of the lowest story up to the ceiling of the uppermost story, and which serves as a guide element for a lift cage. The frame has, below the ceiling of the upper story, a platform consisting of crossbeams for an electric motor, a lift hoisting winch and a switching installation. The lift cage slides on rollers upon the inner sides of angle irons of the frame. Lift cables are fed to a cable drum and wound on and unwound in the opposite sense by way of two deflecting rollers disposed at the height of the platform.

A disadvantage of such known equipment is in that the arrangement of the drive unit and the cable guide is not suitable for a lift installation with a counterweight. It is further disadvantageous that the drive unit, which is arranged below the ceiling, which includes the motor and lift hoisting winch as well as the switching installation, is reachable only with difficulty for servicing operations.

BRIEF DESCRIPTION OF THE INVENTION

The present invention avoids such disadvantages of the known equipment and provides a lift installation with a drive unit which can be arranged in the lift shaft in space-saving manner and is easily accessible.

The lift installation or assembly of the present invention does not need an engine room, whereby the usually required and expensive roof superstructures or cellar spaces for the engine room become redundant. In addition, minimal shaft dimensions are possible, especially in the over-travel region. A further decisive advantage is that the lift installation is independent of the building material and of the load-bearing capability of the shaft roof, because the lift installation merely needs a self-supporting lift shaft.

In accordance with the present invention, the lift installation includes a drive unit which is arranged at the upper end of a lift shaft, and has a drive pulley arrangement about which lift cables for a lift cage and counterweight are run. Preferably, the lift cage is guided within its lift shaft by guides along the length of the shaft. The drive unit is pivotally mounted to allow it to be rotated to a repair orientation.

BRIEF DESCRIPTION OF THE DRAWINGS

The invention is more closely explained in the following by reference to drawings, which illustrate one illustrative embodiment and in which.

DETAILED DESCRIPTION OF THE INVENTION

Figure 1:
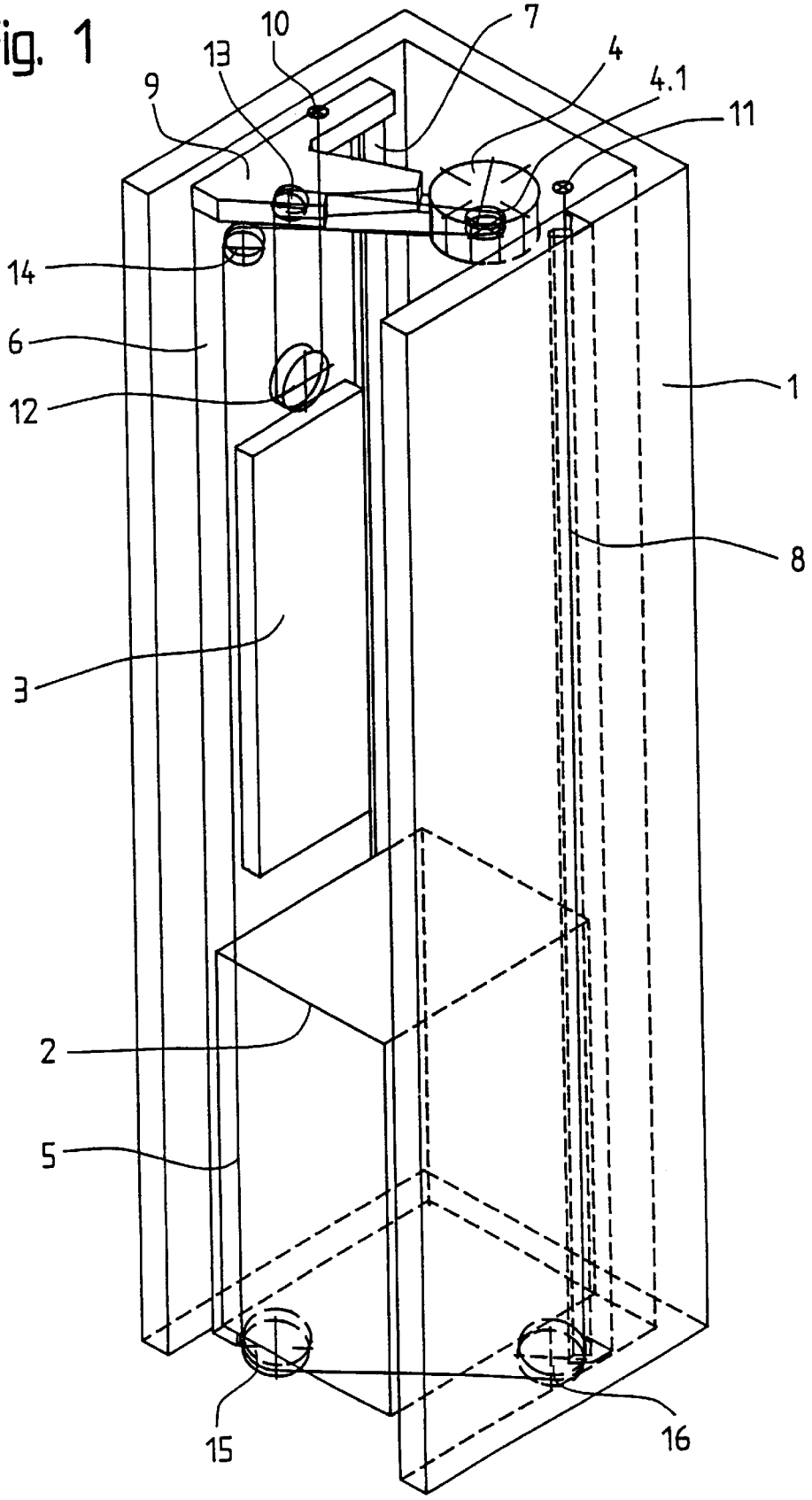
FIG. 1 shows a three-dimensional illustration of a self-supporting shaft with a lift installation according to the invention.

In FIG. 1 a self-supporting shaft is denoted by 1, in which a lift cage 2 and a counterweight 3 are movable. Lift cage 2 and counterweight 3 are driven by a drive unit 4 by means of cables 5 and guided in the lift shaft 1 by guide elements 6, 7, and 8, wherein one limb of a guide element serves for the guidance of the lift cage 2 and the other limb of a guide element serves for the guidance of the counterweight 3. A carrier yoke 9 is arranged at the upper ends of first guide element 6 and second guide element 7. The carrier yoke 9 can also be arranged at the shaft head. The cables 5 terminate on the one hand at a first fixed point 10 of the carrier yoke 9, and on the other hand at a second fixed point 11 on third guide element 8. The cables 5, which for example may consist of synthetic or steel threads, run from the first fixed point 10 by way of a first roller 12 arranged at the counterweight 3, then by way of a second roller 13 arranged at the carrier yoke 9, then by way of a drive pulley 4.1 of the drive unit 4, then by way of a third roller 14 arranged at the carrier yoke 9, then by way of a fourth roller 15 and a fifth roller 16 arranged at the underside of the lift cage 2, and then to the second fixed point 11.

Figure 2:
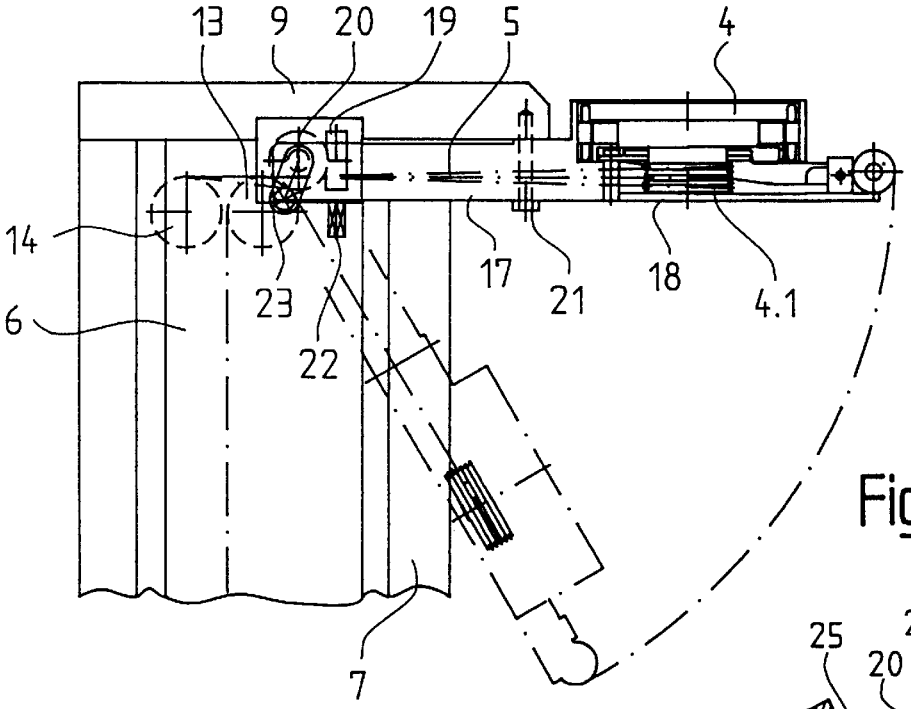
FIG. 2 shows a side view of a rotary mechanism carrying the drive unit of the invention.
Figure 3:
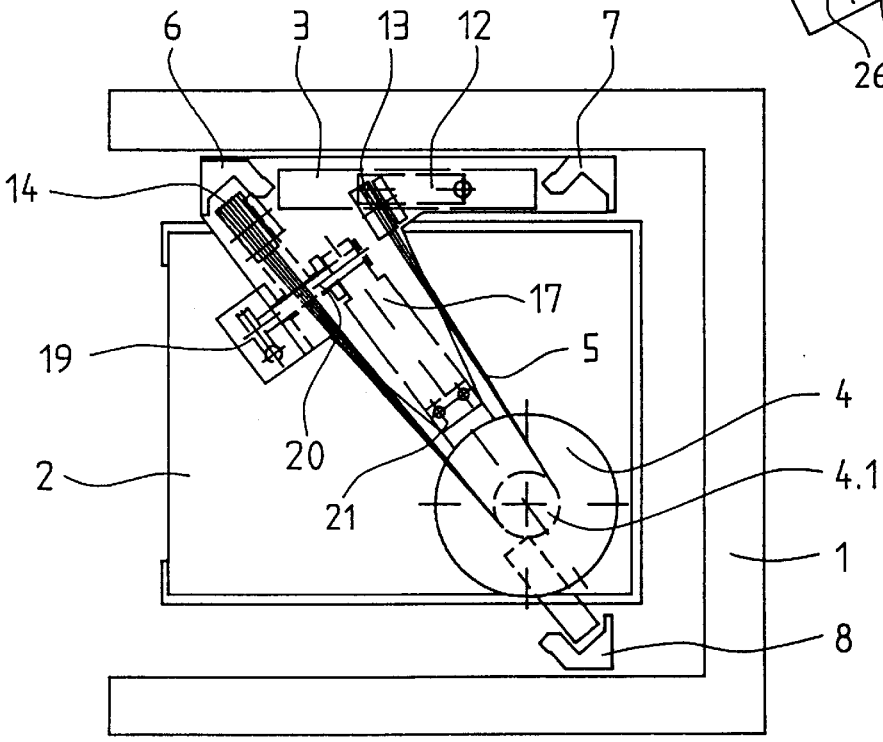
FIG. 3 shows a plan view of the rotary mechanism according to FIG. 2.

FIG. 2 and FIG. 3 show a frame 18, which stands in connection with a pivot arm 17 and upon which the drive unit 4 is arranged. The pivot arm 17 is mounted on a pivot axle 20 drivable by means of a gear 19 and, in the operational state, is connected and secured to the carrier yoke 9 by means of a securing element 21, for example a screw coupling, whereby the drive unit 4 is below a shaft head ceiling, which is not illustrated, in a horizontal position with the drive pulley 4.1 facing downwards as seen in FIG. 2. For pivoting of the drive unit 4 the gear 19 is driven by means of, for example, a crank placeable on a crank pin 22. The gear can also be driven by a motor. The pivot axle 20, driven by means of the gear 19, pivots the pivot arm 17 and thus the frame 18 with the drive unit 4 downwardly into the lift shaft 1. In the lowered position, shown by the broken lines in FIG. 2, mounting, maintenance and repair operations can be carried out easily and with good access. A cable deflector 23 is loosely connected with the pivot axle 20 and prevents any excess cable diagonal pull on the drive pulley 4.1 from occurring.

Figure 4:
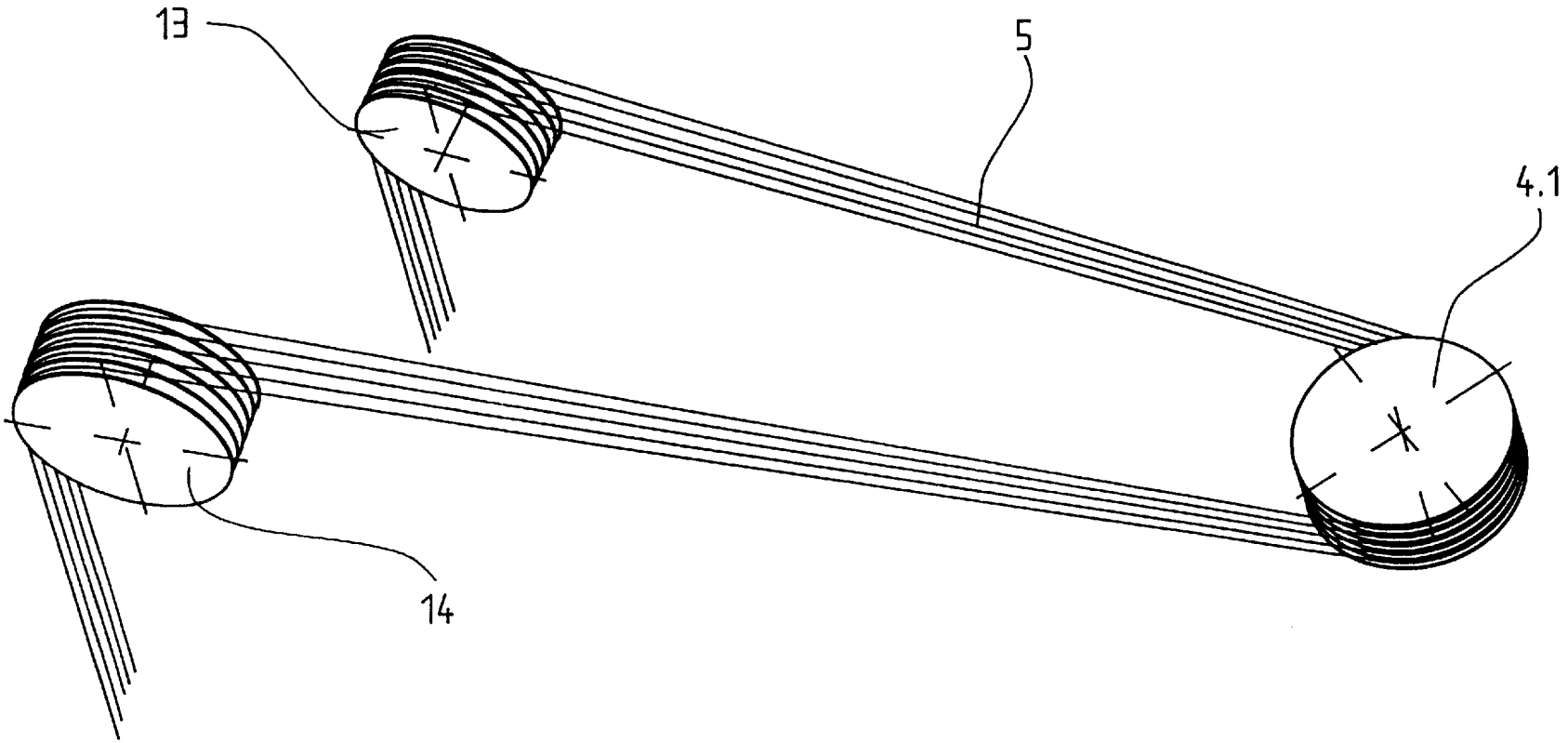
FIG. 4 is a detail illustration of a cable guided between deflecting rollers and a drive pulley of the drive unit.

FIG. 4 shows the guidance of the cables 5 from the second roller 13 to the drive pulley 4.1 and from there to the third roller 14. In such an arrangement, the cable plane is rotated from horizontal to vertical and back to horizontal. With sufficient distance between rollers 13, 14 and drive pulley 4.1, the cable diagonal pull can be disregarded.

Figure 5:
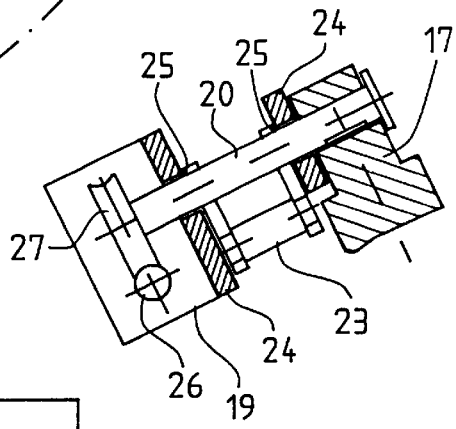
FIG. 5 shows details of the rotary mechanism.

FIG. 5 illustrates the pivot axle 20 held by means of a bearing block 24 and a bearing 25 at the carrier yoke 9. One end of the pivot axle 20 is fixedly connected with the pivot arm 17. A worm wheel 27, driven by means of a worm 26, is arranged at the other end of the pivot axle 20 for pivot motion. The worm 26 stands in connection with the crank pin 22. During a pivot process, the cable deflector 23 mounted loosely at the pivot axle 20 remains in position and prevents excess cable diagonal pull on the drive pulley 4.1.

Figure 6:
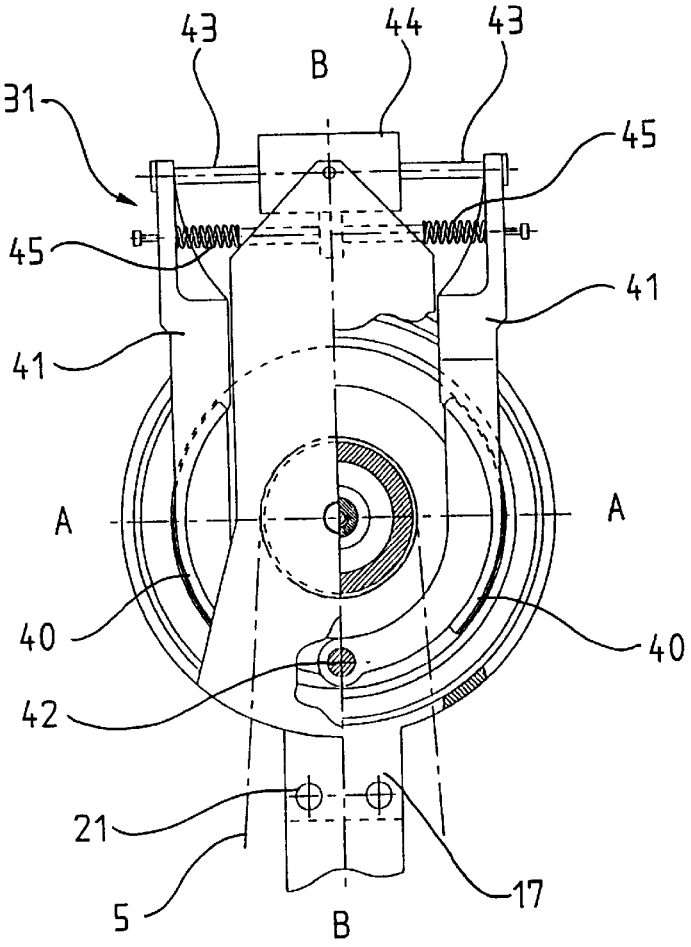
FIG. 6 shows an elevation of a drive unit comprising a motor, brake unit, drive pulley and transmitter.
Figure 8:
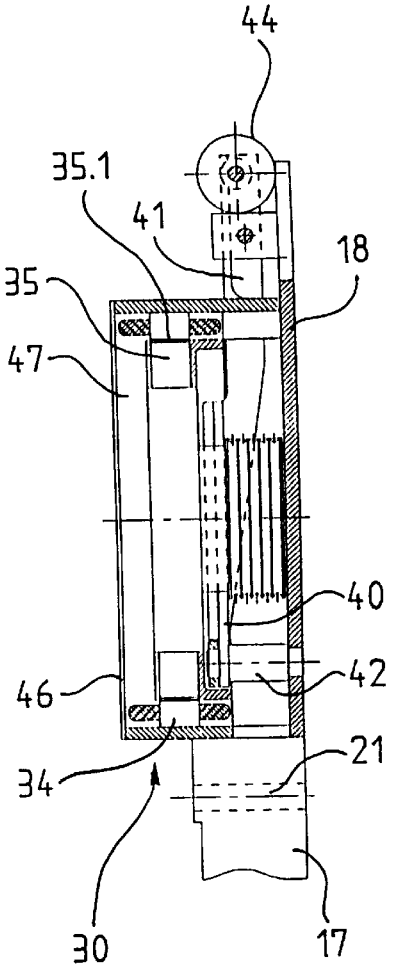
FIG. 8 shows a section of the drive unit along the line B—B of FIG. 6.
Figure 7:
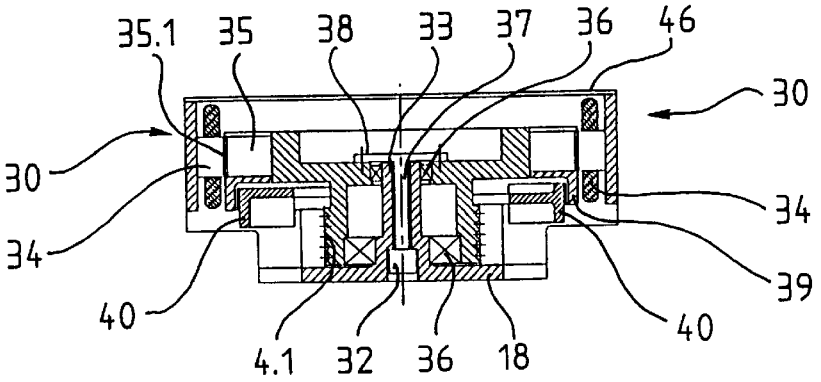
FIG. 7 shows a section of the drive unit along the line A—A of FIG. 6.

FIGS. 6, 7 and 8 show a drive unit as consisting of an annular motor 30, which may be, for example, a synchronous motor with a high number of poles, a brake unit 31, a tachometer 32 and the frame 18. As evident from FIG. 7, the frame 18 may have the form of a key having a central hollow axle 33 and is connected at its foot with the pivot arm 17. An annular stator 34 of motor 30 is arranged at the inner wall of the frame 18. The motor rotor 35 and drive pulley 4.1 form a rotating unit, which is rotatably supported upon the hollow axle 33 by means of bearings 36. The bearings 36 accept the forces of the drive pulley 4.1 and guide the rotor 35 and drive pulley 4.1. The tachometer 32 is arranged in the hollow axle 33 at the drive pulley side and is driven by means of a shaft 37 extending through the hollow axle 33, wherein the shaft 37 is connected with the rotating rotor and drive pulley unit by means of a plate 38. The motor rotor 35 has lamination stacks with permanent magnets 35.1 which are clamped by retainers 39. So formed they can accept, at the inner side, friction forces applied by internal brake shoes 40 of the brake unit 31. The internal brake shoes 40 are arranged on brake shoe levers 41. The brake shoe levers 41 are, at one end, rotatably mounted about a pin 42 fixedly connected to the frame 18. At their other ends each is connected to a respective actuating element 43 of an electromagnet 44. The electromagnet 44 relieves the internal brake shoes 40 from brake-applying spring forces produced by means of springs 45. Electromagnet 44 and springs 45 are attached symmetrically and connected with the frames 18, so that the brake unit 31 remains functionally operable even in the case of failure of one brake half.

The actual opening of the key-like frame 18 is closed by means of a cover 46. Under the cover 46 is a space 47 for electronic and regulating components (now shown) of the drive unit 4.

We claim:

1. A lift assembly comprising a drive unit which is arranged at the upper end of a lift shaft, said drive unit comprising a drive pulley for cage drive by means of cables coupled to both a lift cage, which is guided in the lift shaft by guide elements and a counterweight, and a pivot mechanism supporting said drive unit, said pivot mechanism being pivotable downwardly into the lift shaft.

2. The lift assembly according to claim 1, wherein said pivot mechanism comprises a carrier yoke and a pivot arm arranged at the upper end of at least one of the guide elements and the lift shaft, said pivot arm being movably connected at a first end with the carrier yoke, a second of said pivot arm carrying a frame, said drive unit being affixed to said frame.

3. The lift assembly according to claim 2, further comprising a pivot axle located at the carrier yoke, said pivot axle being coupled to a gear for driving the pivot arm.

4. The lift assembly according to claim 3, characterized in that in the operational state for the lift cage the pivot arm is fixedly connected and secured with the carrier yoke by means of a securing element (21) having means for orienting the drive unit in a horizontal position with the drive pulley facing downwards in the lift shaft.

5. The lift assembly according to claim 3, characterized in that the gear is drivable by means of hand crank or motor.

6. The lift assembly according to any of claims 1 through 5, wherein the drive unit comprises an annular motor and a brake unit and a tachometer coupled to the motor, wherein the frame has the form of a key with a central hollow axle and is connected at a foot with the pivot arm.

7. The lift assembly according to claim 6, wherein said motor includes an annular stator and a rotor, the stator being arranged at the inner wall of the frame, the rotor and the drive pulley forming a rotating unit which is rotatably supported at the hollow axle by means of bearings.

8. The lift assembly according to claim 6, wherein the rotor includes retainers, the brake unit comprises internal brake shoes to engage the retainers at inner sides thereof.

9. The lift assembly according to claim 6, wherein the tachometer is arranged in the hollow axle and is driven by means of a shaft which extends in the hollow axle and is connected with the rotor.

10. The lift assembly according to claim 6, characterized in that the motor is a multi-pole synchronous motor.

11. The lift assembly according to claim 7, wherein the rotor includes retainers, the brake unit comprises internal brake shoes to engage the retainers at inner sides thereof.

* * * * *